US007598467B2

(12) United States Patent
Gibson et al.

(10) Patent No.: US 7,598,467 B2
(45) Date of Patent: Oct. 6, 2009

(54) ELECTRICAL SWITCHING APPARATUS HAVING A CRADLE WITH COMBINED PIVOT AND OVER-TOGGLE REVERSING PIN

(75) Inventors: Perry R. Gibson, East Palestine, OH (US); Douglas C. Marks, Murrysville, PA (US); Paul R. Rakus, Beaver Falls, PA (US); Robert M. Slepian, Murrysville, PA (US); David M. Olszewski, Coraopolis, PA (US)

(73) Assignee: Eaton Corporation, Cleveland, OH (US)

( * ) Notice: Subject to any disclaimer, the term of this patent is extended or adjusted under 35 U.S.C. 154(b) by 343 days.

(21) Appl. No.: 11/744,654

(22) Filed: May 4, 2007

(65) Prior Publication Data

US 2008/0271982 A1 Nov. 6, 2008

(51) Int. Cl.
*H01H 5/00* (2006.01)

(52) U.S. Cl. ..... 200/400; 200/401

(58) Field of Classification Search ..... 200/1 R, 200/11 TC, 17 R, 18, 50.32, 50.33, 50.37, 200/50.38, 50.39, 400, 401, 337
See application file for complete search history.

(56) References Cited

U.S. PATENT DOCUMENTS 6,515,245 B2 * 2/2003 Marin-Pache et al. ..... 200/400
6,563,067 B2 * 5/2003 Ohtsuka et al. ..... 200/400
6,765,157 B2 * 7/2004 Rademacher et al. ..... 200/1 R
6,777,635 B2 * 8/2004 Baginski et al. ..... 200/401
7,368,677 B2 * 5/2008 Jones et al. ..... 200/400
7,435,920 B1 * 10/2008 Yoo ..... 200/50.32
7,449,652 B2 * 11/2008 Rakus et al. ..... 200/400
7,449,653 B2 * 11/2008 Gibson et al. ..... 200/400

* cited by examiner

*Primary Examiner*—Michael A Friedhofer
(74) *Attorney, Agent, or Firm*—Martin J. Moran

(57) ABSTRACT

The present invention provides for an electrical switching apparatus operating mechanism opening assembly wherein the toggle assembly stop/kicker pin has been separated into a kicker pin and a stop pin. By separating the functions of the stop/kicker pin into separate pins, the kicker pin may now be located at the pivot point of the associated link. Further, the kicker pin and the stop pin are now disposed upon a cradle assembly as opposed to an elongated link. The cradle assembly further supports one of the toggle assembly links. Thus, rotation of the cradle assembly causes the toggle assembly to move. The operating mechanism opening assembly is configured so that, when an associated latch assembly latch plate assembly is released, the cradle assembly rotates so that the toggle assembly is moved away from a closing assembly closing device.

20 Claims, 7 Drawing Sheets

ELECTRICAL SWITCHING APPARATUS HAVING A CRADLE WITH COMBINED PIVOT AND OVER-TOGGLE REVERSING PIN

CROSS REFERENCE TO RELATED APPLICATION

This application is related to commonly assigned, concurrently filed:

U.S. patent application Ser. No. 11/744,431, filed May 4, 2007, entitled "ELECTRICAL SWITCHING APPARATUS, AND YOKE ASSEMBLY AND SPRING ASSEMBLY THEREFOR", which is incorporated by reference.

BACKGROUND OF THE INVENTION

1. Field of the Invention

The present invention relates to an electrical switching apparatus operating mechanism and, more specifically to an electrical switching apparatus operating mechanism opening assembly having a cradle assembly with a pivot shaft that acts as a kicker for a toggle assembly.

2. Background Information

Electrical switching apparatus, typically, include a housing, at least one bus assembly having a pair of contacts, a trip device, and an operating mechanism. The housing assembly is structured to insulate and enclose the other components. The at least one pair of contacts include a fixed contact and a movable contact and typically include multiple pairs of fixed and movable contacts. Each contact is coupled to, and in electrical communication with, a conductive bus that is further coupled to, and in electrical communication with, a line or a load. A trip device is structured to detect an over-current condition and to actuate the operating mechanism. An operating mechanism is structured to both open the contacts, either manually or following actuation by the trip device, and close the contacts.

That is, the operating mechanism includes both a closing assembly and an opening assembly, which may have common elements, that are structured to move the movable contact between a first, open position, wherein the contacts are separated, and a second, closed position, wherein the contacts are coupled and in electrical communication. The operating mechanism includes a rotatable pole shaft that is coupled to the movable contact and structured to move each movable contact between the closed position and the open position. Elements of both the closing assembly and the opening assembly are coupled to the pole shaft so as to effect the closing and opening of the contacts.

In the prior art, an electrical switching apparatus operating mechanism closing assembly typically had a stored energy device, such as an closing spring, and at least one link coupled to the pole shaft. The at least one link, typically, included two links that acted cooperatively as a toggle assembly. When the contacts were open, the toggle assembly was in a first, collapsed configuration and, conversely, when the contacts were closed, the toggle assembly was, typically, in a second, in-line position or in a slightly over-toggle configuration. The toggle assembly typically moved through a third configuration, a reset configuration, while the contacts were open and which was a configuration during the resetting of the operating mechanism prior to closing the contacts. The opening spring biased the pole shaft to collapse the toggle assembly. The opening spring and toggle assembly were maintained in the second, in-line position by the trip device.

The force required to close the contacts was, and is, typically greater than what a human may apply and, as such, the operating mechanism typically included a mechanical closing assembly to close the contacts. The closing assembly, typically, included at least one stored energy device, such as a spring, and/or a motor. Closing springs typically were about 2 inches in diameter and about 5 to 6 inches in length. These springs were structured to apply a force of about 1000 pounds. A common configuration included a motor that compressed one or more springs in the closing assembly. That is, the closing springs were coupled to a cam roller that engaged a cam coupled to the motor. As the motor rotated the cam, the closing springs were compressed or charged.

The toggle assembly also included a cam roller, typically at the toggle joint. The closing assembly further included one or more cams disposed on a common cam shaft with the closing spring cam. Alternatively, depending upon the configuration of the cam, both the closing spring cam roller and the toggle assembly cam roller could engage the same cam. When the closing springs were released, the closing spring cam roller applied force to the associated cam and caused the cam shaft to rotate. That is, the cam roller "operatively engaged" the cam. Rotation of the cam shaft would also cause the cam associated with the toggle assembly cam roller to rotate. As the cam associated with the toggle assembly cam roller rotated, the cam caused the toggle assembly cam roller, and therefore the toggle assembly, to be moved into selected positions and/or configurations. More specifically, the toggle assembly was moved so as to rotate the pole shaft into a position wherein the contacts were closed. Thus, the stored energy from the closing springs was transferred via the cams, cam shaft, toggle assembly, and pole shaft to the contacts. Alternatively, as set forth in U.S. patent application Ser. No. 11/693,198, filed Mar. 29, 2007, which is incorporated herein by reference, a closing assembly may also utilize a ram assembly to act upon the toggle assembly. That is, as opposed to a cam moving the toggle assembly into the second, over-toggle position, a linearly traveling ram acts upon the toggle assembly at the toggle joint.

The electrical switching apparatus operating mechanism opening assembly is structured to open the contacts by allowing the pole shaft to rotate. That is, a trip device included an over-current sensor, a latch assembly and may have included one or more additional links that were coupled to the toggle assembly. Alternately, the latch assembly was directly coupled to the toggle assembly. When an over-current situation occurred, the latch assembly was released allowing the opening spring to cause the toggle assembly to collapse. When the toggle assembly collapsed, the toggle assembly link coupled to the pole shaft caused the pole shaft to rotate and thereby move the movable contacts into the open position. The latch assembly could also be actuated manually if desired.

The electrical switching apparatus operating mechanism opening assembly is responsive to the release of the latch assembly and is structured to move the toggle assembly into the first, collapsed configuration. Typically, the latch assembly included a latch plate that was structured to rotate or pivot within the housing assembly. The latch plate included a latch edge that selectively engaged a D-shaft. When the D-shaft was in a first position, the D-shaft allowed the latch plate to pivot. When the D-shaft was in a second configuration, the latch plate latch edge engaged the D-shaft and the latch plate could not rotate. The D-shaft was controlled by the trip device or by a manual input.

One or more links extended between the latch plate and the toggle assembly. When the latch plate was held in place by the D-shaft, the motion of the toggle assembly is controlled by the rotation of the pole shaft and the closing assembly. When the latch plate is free to pivot, the latch plate, via the links, caused the toggle assembly to move. Thus, when the trip device, or a manual input, caused the D-shaft to rotate, the latch plate was free to pivot which in turn caused the toggle assembly to move from the second, over-toggle configuration to the first, collapsed configuration thereby allowing the contacts to separate. To reset the operating mechanism opening assembly prior to the closing of the contacts by the closing assembly, the toggle assembly typically moved into a reset configuration. In this configuration the contacts are open, but the D-shaft is reset and the latch plate latch edge re-engages the D-shaft. Thus, the latch plate is no longer free to rotate and the motion of the toggle assembly is controlled by the pole shaft and the closing assembly as set forth above.

The operating mechanism opening assembly typically included a stop/kicker pin. The stop/kicker pin was typically disposed in one of two locations, either on the link between the latch plate and the toggle assembly or fixed to the housing assembly. The stop/kicker pin initially stops the motion of the toggle assembly during closing. That is, the stop/kicker pin, acting in the stop pin capacity, was positioned so that when the closing assembly moved the toggle assembly through the toggle, the stop/kicker pin arrested the motion of the toggle assembly in the second, over-toggle configuration. Typically, without the stop/kicker pin, the toggle assembly would collapse in a reverse direction. When the latch plate was released, the motion of the latch plate would cause the link between the latch plate and the toggle assembly to move toward the toggle assembly or, of the kicker pin was fixed, caused the toggle assembly to move toward the kicker pin. As the stop/kicker pin was contacting the toggle assembly and holding the toggle assembly in the second, over-toggle configuration, the relative motion of the stop/kicker pin toward the toggle assembly caused the toggle assembly to pass back through the in-line position and, once the toggle assembly was through the toggle, the toggle assembly could collapse. That is, the stop/kicker pin caused the toggle assembly to move into the first, collapsed configuration. Typically, there was some delay in the relative motion of the kicker pin and the toggle assembly because the stop/kicker pin was typically spaced from the pivot point of the associated link or the toggle assembly. That is, as the assembly that moved would initially move with a slow angular velocity about a pivot point that is distant from the kicker pin. Thus, the time between a release of the latch plate and the collapse of the toggle assembly was extended. This is a disadvantage as the contacts are not separated until the toggle is substantially collapsed.

In this configuration, the operating mechanism opening assembly and closing assembly are disposed adjacent to each other. The closeness of the operating mechanism opening assembly and closing assembly can create interference problems that must be addressed. For example, after the closing assembly moves the toggle assembly into the second, over-toggle configuration, the closing assembly closing device, e.g. the cam or ram as set forth above, is still disposed immediately adjacent to the toggle assembly. Under normal operating conditions, the closing assembly closing device is simply reset, thereby moving the closing assembly closing device away from the toggle assembly. If, however, an over-current condition occurs immediately after the closing of the contacts, the closing assembly closing device and the toggle assembly must be separated so that the toggle assembly may collapse. Present configurations of the operating mechanism typically cause the closing assembly closing device to be moved out of the way or allow the toggle assembly links to be separated. Both of these solutions have disadvantages. An assembly structured to move the closing assembly closing device away from the toggle assembly increases charging difficulty. An assembly structured to separate the toggle links, and subsequently recouple the toggle links adds complexity to the opening assembly.

There is, therefore, a need for an electrical switching apparatus operating mechanism opening assembly wherein the kicker pin and the associated pivot point correspond to each other.

There is a further need for an electrical switching apparatus operating mechanism opening assembly wherein the toggle assembly is moved away from the closing assembly closing device rather than having the toggle assembly separate or having the closing assembly closing device move away from the toggle assembly.

SUMMARY OF THE INVENTION

These needs, and others, are met by the present invention which provides for an electrical switching apparatus operating mechanism opening assembly wherein the toggle assembly stop/kicker pin has been separated into a kicker pin and a stop pin. By separating the functions of the stop/kicker pin into separate pins, the kicker pin may now be located at the pivot point of the associated link. Further, the kicker pin and the stop pin are now disposed upon a cradle as opposed to an elongated link. The cradle has a faster initial rotation than the links of the prior art. The cradle further supports one of the toggle assembly links. Thus, rotation of the cradle causes the toggle assembly to move. The operating mechanism opening assembly is configured so that, when the associated latch assembly latch plate is released, the cradle rotates so that the toggle assembly is moved away from the closing assembly closing device. Thus, as the kicker pin is both the pivot point and the rotation of the cradle is faster, there is a shorter time between the release of the latch plate and the collapse of the toggle assembly.

Further, with these improvements, there is a further need for a device that positions the cradle with respect to the latch plate and that prevents the cradle from over-rotating relative to the latch plate. That is, a device that limits the motion of the cradle relative to the latch plate so that the motion of the cradle is controlled during opening and closing of the contacts. This need is met by a latch plate link having a rotation stopping assembly. That is, the latch plate assembly includes an over-rotation pin and the latch plate link has a longitudinal extension that is structured to engage the over-rotation pin. Thus, as the cradle moves relative to the latch plate, the latch plate link is also in motion. When the latch plate link longitudinal extension engages the over-rotation pin, the movement of the cradle relative to the latch plate is limited. Thus, the motion of the cradle is controlled during opening and closing of the contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components so coupled move as one.

As used herein, "operatively engage" when used in relation to a component that is directly coupled to a cam means that a force is being applied by that component to the cam sufficient to cause the cam to rotate.

As used herein, a "pivot point" is a coupling between two or more members that allows the members to pivot relative to each other. A pivot point may be, but is not limited to, an opening on each member and a separate rod, wherein the rod extends through the openings, or, a rod on a first element and an opening on a second element wherein the first element rod extends through the second element opening.

As used herein, links or members that are "pivotally coupled" to each other are coupled at a "pivot point."

As used herein, with reference to the kicker pin acting upon the toggle assembly, and more specifically the kicker pin "causing" the toggle assembly to collapse, the word "cause" is defined broadly to include accelerating a collapse. That is, a toggle assembly, especially a toggle assembly that is held in the in-line configuration, may begin to collapse without contacting a kicker pin. Such a collapse, however, is slow and contact with a kicker pin substantially increases the speed of the collapse.

Figure 1:
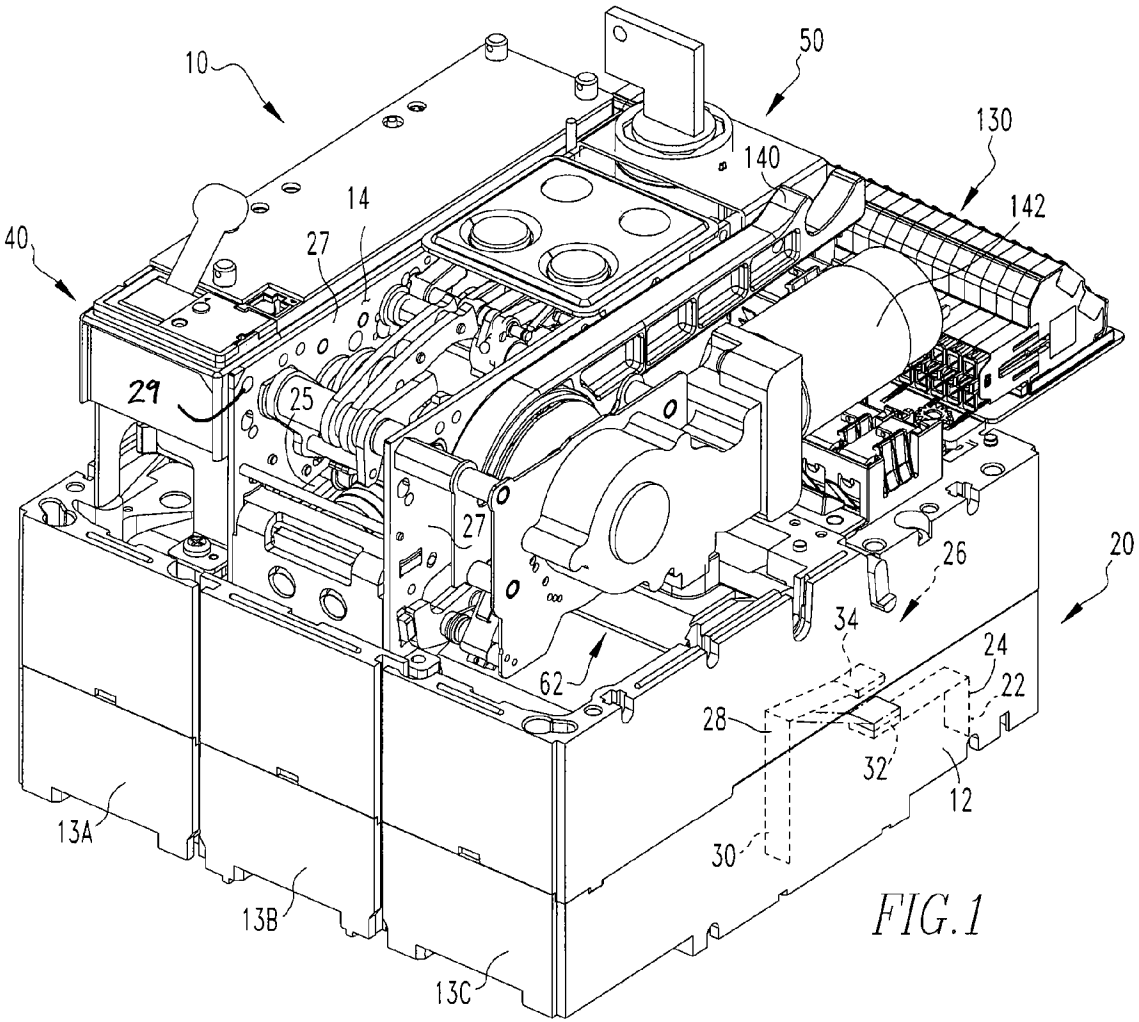
FIG. 1 is an isometric view of an electrical switching apparatus with a front cover removed.

As shown in FIG. 1, an electrical switching apparatus 10 includes a housing assembly 12 defining an enclosed space 14. In FIG. 1, the front cover of the housing assembly 12 is not shown, but it is well known in the art. The electrical switching apparatus 10 further includes a conductor assembly 20 (shown schematically) having at least one line terminal 22, at least one line conductor 24, at least one pair of separable contacts 26, at least one load conductor 28 and at least one load terminal 30. The at least one pair of separable contacts 26 include a fixed contact 32 and a movable contact 34. The movable contact 34 is structured to move between a first, open position, wherein the contacts 32, 34 are separated, and a second, closed position, wherein the contacts 32, 34 contact each other and are in electrical communication. The electrical switching apparatus 10 further includes a trip device 40 and an operating mechanism 50. The operating mechanism 50, which is discussed in more detail below, is generally structured to move the at least one pair of separable contacts 26 between the first, open position and the second, closed position. The trip device 40 is structured to detect an over-current condition and, upon detecting such a condition, to actuate the operating mechanism 50 to open the at least one pair of separable contacts 26.

The electrical switching apparatus 10 also includes at least two, and typically a plurality, of side plates 27. The side plates 27 are disposed within the housing assembly 12 in a generally parallel orientation. The side plates 27 include a plurality of openings 29 to which other components may be attached or through which other components may extend. The openings 29 on two adjacent side plates 27 are typically aligned. While side plates 27 are the preferred embodiment, it is understood that the housing assembly 12 may also be adapted to include the required openings and/or attachment points thereby, effectively, incorporating the side plates 27 into the housing assembly 12 (not shown).

An electrical switching apparatus 10 may have one or more poles, that is, one or more pairs of separable contacts 26 each having associated conductors and terminals. As shown in the figures, the housing assembly 12 includes three chambers 13A, 13B, 13C each enclosing a pair of separable contacts 26 with each being a pole for the electrical switching apparatus 10. A three-pole configuration, or a four-pole configuration having a neutral pole, is well known in the art. The operating mechanism 50 is structured to control all the pairs of separable contacts 26 within the electrical switching apparatus 10. Thus, it is understood selected elements of the operating mechanism 50, such as, but not limited to, the pole shaft 70 (discussed below) span all three chambers 13A, 13B, 13C and engage each pair of separable contacts 26. The following discussion, however, shall not specifically address each specific pair of separable contacts 26.

Figure 2:
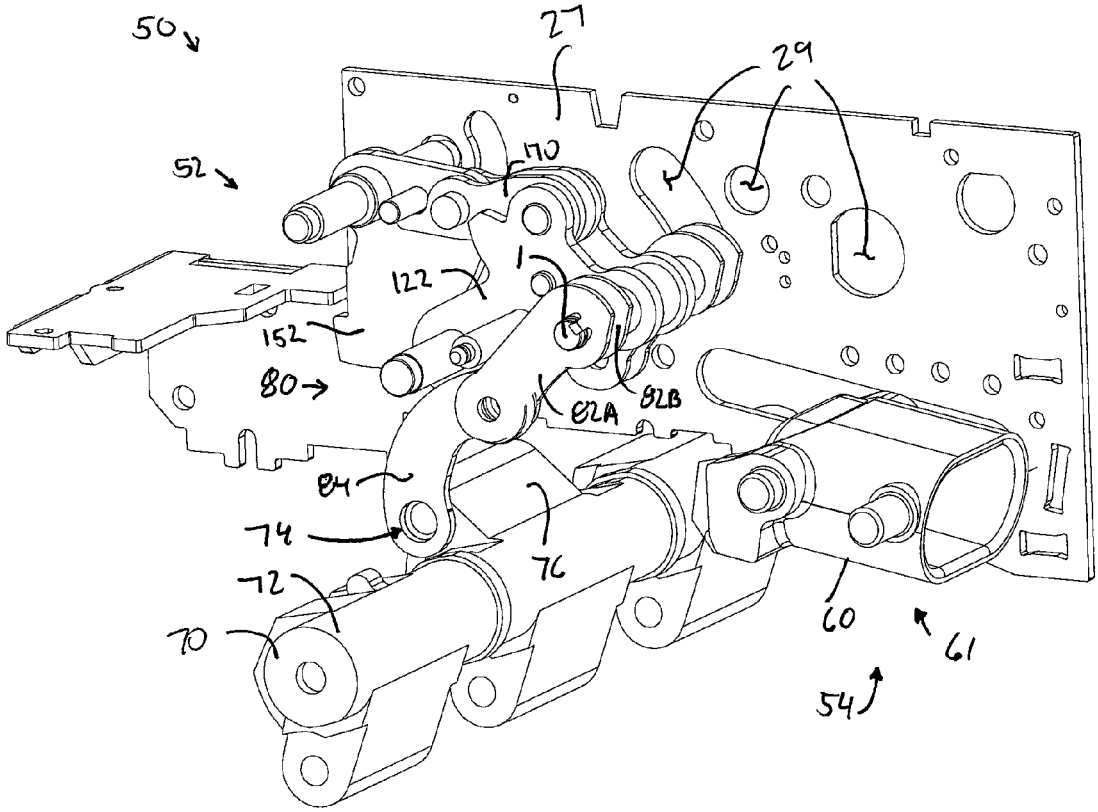
FIG. 2 is an isometric view of the opening assembly with a side plate removed for clarity.

As shown in FIG. 2, the operating mechanism 50 includes an opening assembly 52, structured to move the at least one pair of separable contacts 26 from the second, closed position to the first, open position, and a closing assembly 54, structured to move the at least one pair of separable contacts 26 from the first, open position to the second closed position. The opening assembly 52 and the closing assembly 54 both utilize common components of the operating mechanism 50. The operation of the closing assembly 54 is set forth in detail in U.S. patent application Ser. No. 11/693,198, which has been incorporated by reference. It is noted that the closing assembly 54 includes a ram 60 structured to engage the toggle joint 94, discussed below, and move the toggle assembly 80 from a reset position to the closed position. Thus, in this embodiment the ram 60 is a link driving device 61. It is further noted that the ram 60 when it is in the discharged position is disposed adjacent to the toggle assembly 80 and acts as an obstacle to collapse 62 for the toggle assembly 80.

The opening assembly 52 includes a pole shaft 70, a toggle assembly 80, a cradle assembly 120, and may contain latching assembly 140 having a latch plate assembly 150 and a latch plate link 170. It is noted that the latching assembly 140 may also be considered to be part of the trip device 40. The pole shaft 70 is an elongated shaft body 72 rotatably coupled to the housing assembly 12 and/or side plates 27. The pole shaft 70 includes a plurality of mounting points 74 disposed on mounting blocks 76 extending from the pole shaft body 72. As shown schematically in FIG. 1, the pole shaft 70 is coupled to the movable contact 34. The pole shaft 70 is structured to move between a first position, wherein the movable contact 34 is in its first, open position, and a second position, wherein the movable contact 34 is in its second, closed position. As set forth in concurrently filed U.S. patent application Ser. No. 11/744,431, entitled "ELECTRICAL SWITCHING APPARATUS, AND YOKE ASSEMBLY AND SPRING ASSEM- BLY THEREFOR", one or more closing springs bias the pole shaft 70 to rotate in the direction indicated by the arrow on FIG. 3.

It is noted that, as shown in FIG. 2, a single component, e.g. a first link 82 in the toggle assembly 80 may include two, or more, members 82A, 82B with similar shapes which are held in a spaced relationship and which move in concert. The use of multiple, separate members 82A, 82B may be used, for example, to provide added strength to the link 82 or where space considerations do not allow for a single thick member 82A, 82B. Because these link members 82A, 82B perform the same function, have a similar shape, and move in concert, the following discussion will simply identify the link 82 by a single reference number as is shown in the side views of FIGS. 4-7. It is understood that the description of such a component applies to each member 82A, 82B of that component. It is further noted that such components typically rotate within a single plane. Thus, it is understood that where components are shown to overlap in FIGS. 4-7, those components are in different planes. It is further understood that components that extend perpendicular to the planes of the various components may contact more than one component. As used herein with reference to the opening assembly 52, the word "lateral" preceding an element indicates that such an element extends across the planes of two or more other elements.

As shown in FIGS. 3-7, the toggle assembly 80 includes a first link 82 and a second link 84 which are each generally flat, elongated bodies. The second link 84 body is also curved as set forth below. The first and second links 82, 84 each have a first, outer end 86, 88 (respectively) and a second, inner end 90, 92 (respectively). A pivot point is disposed at each of the first and second links first, outer ends 86, 88 and second, inner ends 90, 92. The first link 82 and the second link 84 are pivotally coupled together at the first link second, inner end 90 and the second link second, inner end 92 by a toggle joint 94. In this configuration, the first and second links 82, 84 form a toggle joint 94. The toggle joint 94 may include a toggle roller 98. That is, the toggle joint 94 may include a pin 100 extending generally perpendicular to the plane of each link 82, 84. The pin 100 may also define an axle for the toggle roller 98 which is, essentially, a wheel. The toggle roller 98 has a diameter of sufficient size to extend past the edges of the first and second links 82, 84.

The cradle assembly 120 includes an elongated body 122, a lateral pivot shaft 124, and a lateral stop pin 126. The cradle assembly body 122 has a first link pivot point 128. The cradle assembly body 122 is coupled to the cradle assembly lateral pivot shaft 124. The cradle assembly lateral pivot shaft 124 is disposed between, and rotatably coupled to the hosing assembly side plates 27. Thus, the cradle assembly body 122 may pivot about a fixed axis which is the cradle assembly lateral pivot shaft 124. The lateral stop pin 126 is disposed generally between the cradle assembly lateral pivot shaft 124 and the first link pivot point 128. The cradle assembly body 122 preferably includes an offset portion 130 having a latch plate link pivot point 132.

The latch plate assembly 150 includes a body 152 and a lateral pivot shaft 154. The latch plate assembly body 152 has a latch edge 153, a latch plate link pivot point 156, and a lateral over rotation pin 158. The latch plate assembly body 152 is coupled to the latch plate assembly lateral pivot shaft 154. The latch plate assembly lateral pivot shaft 154 is disposed between, and rotatably coupled to the hosing assembly side plates 27. Thus, the latch plate assembly body 152 may pivot about a fixed axis which is the latch plate assembly lateral pivot shaft 154. The lateral over rotation pin 158 is disposed, generally, between the latch plate assembly lateral pivot shaft 154 and the latch plate assembly body latch plate link pivot point 156. The latch plate assembly body latch edge 153 is structured to engage a D-shaft 160 or similar device that is part of the operating mechanism 50. Details of the D-shaft 160 and its operation are set forth in U.S. patent application Ser. No. 11/737,219 which is incorporated herein by reference. For the purpose of this application it is noted that the D-shaft 160 is structured to selectively rotate between a first position and a second position.

The latch plate link 170 has an elongated body 172 with a first pivot point 174, a second pivot point 176 and a longitudinal extension 178. The longitudinal extension 178 extends generally longitudinally outwardly beyond the latch plate link body first pivot point 174. The longitudinal extension 178 is structured to engage the latch plate assembly over rotation pin 158.

The opening assembly 52 is assembled as follows. It is noted that the pole shaft 70, the cradle assembly lateral pivot shaft 124 and the latch plate assembly lateral pivot shaft 154 are the three components that are rotatably coupled to the housing assembly side plates 27 and, as such, these three shafts 70, 124, 154 are the pivot points that do not move relative to the housing assembly 12. The pole shaft 70, as noted above, is rotatably coupled to the housing assembly side plates 27. The second link 84 is coupled to the pole shaft 70 and, more specifically, the second link first, outer end 88 is pivotally coupled to a pole shaft mounting points 74. As the pole shaft mounting points 74 are offset from the pole shaft 70 axis, rotation of the pole shaft 70 causes the second link first, outer end 88 to move through an arc. As noted above, the first link 82 and the second link 84 are pivotally coupled to each other at the toggle joint 94. The first link 82 is coupled to the cradle assembly body 122. That is, the first link, first outer end 86 is pivotally coupled to the cradle assembly body first link pivot point 128. As the cradle assembly body first link pivot point 128 is spaced from the cradle assembly lateral pivot shaft 124, as the cradle assembly body 122 pivots, the cradle assembly body first link pivot point 128 also moves through an arc. It is noted that, as shown on FIG. 2, a pin 1 may extend through multiple members 82A, 82B and extend to the side plate 27. As this pin 1 must move through an arc, the side plate opening 29 associated therewith is an arcuate opening.

The latch plate link second pivot point 176 is pivotally coupled to the cradle assembly body latch plate link pivot point 132. The latch plate link first pivot point 174 is pivotally coupled to the latch plate assembly body latch plate link pivot point 156. The latch plate link longitudinal extension 178 extends adjacent to, and is structured to engage, the lateral over rotation pin 158.

Figure 3:
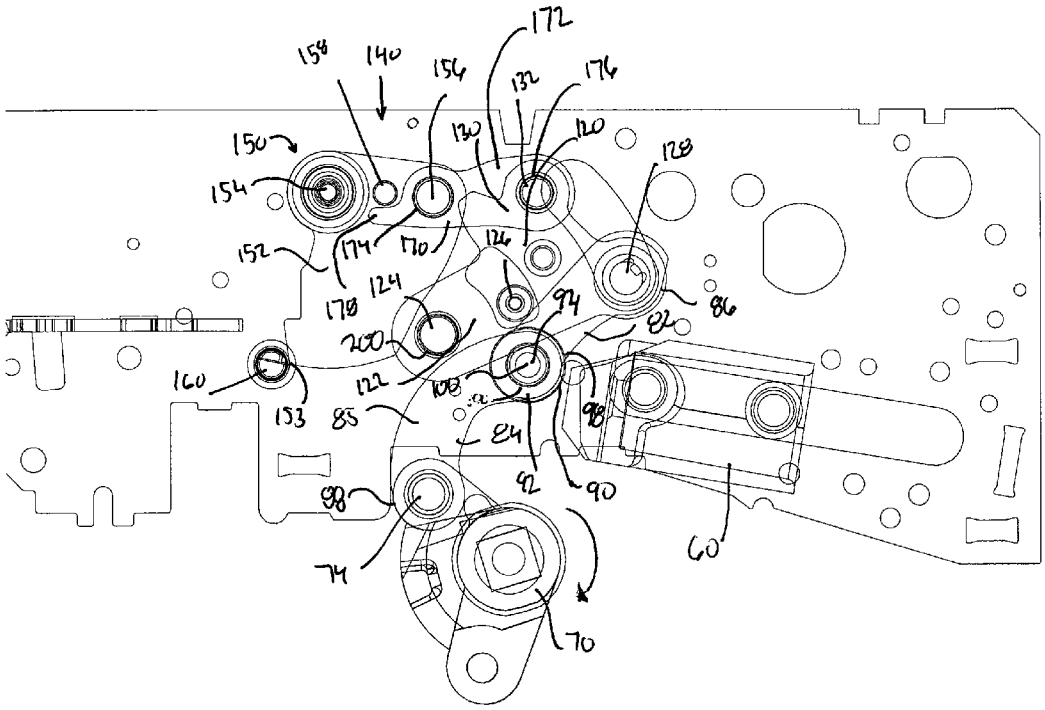
FIG. 3 is a schematic side view of the opening assembly when the contacts are closed.
Figure 7:
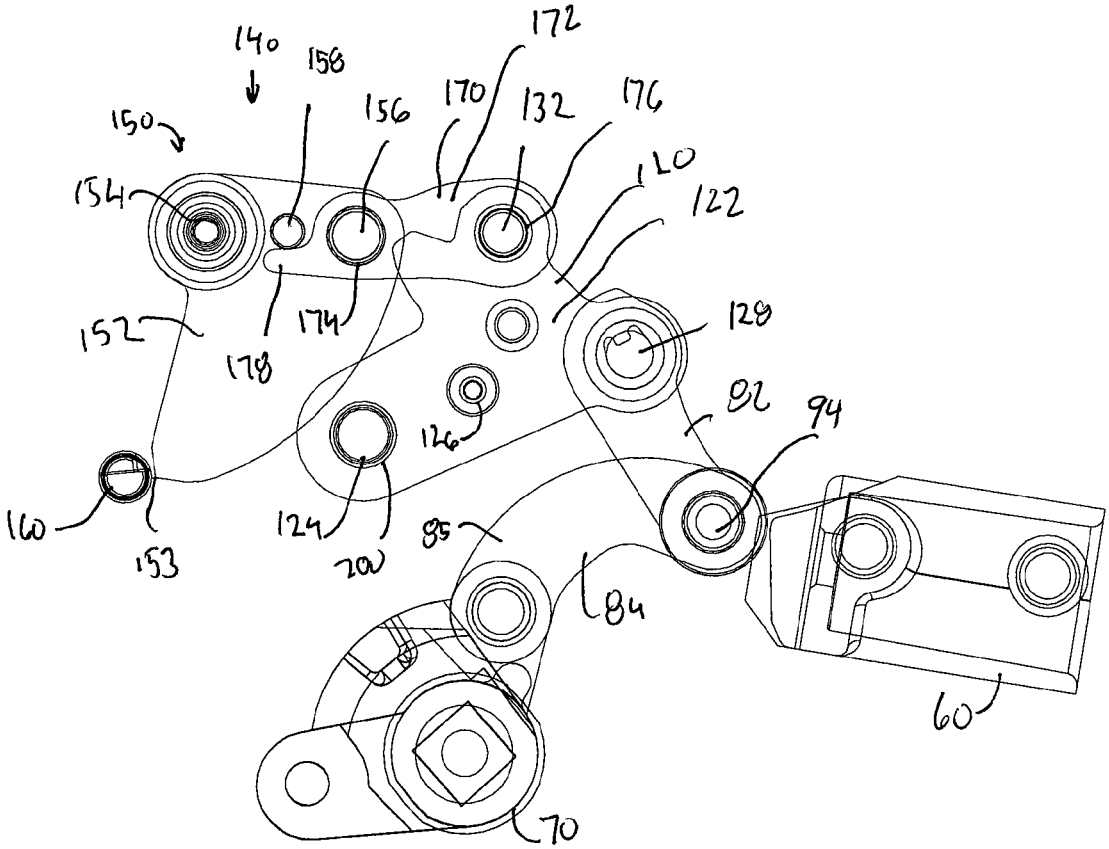
FIG. 7 is a schematic side view of the opening assembly when the contacts are open, the toggle assembly is in the reset configuration, and the ram assembly is charged.

The toggle assembly 80 is structured to move between a first, collapsed configuration (FIG. 5), a reset configuration (FIG. 7), and a second, slightly over-toggle configuration (FIG. 3). In the over-toggle configuration, the toggle assembly 80 is typically between about 5 degrees and 15 degrees past toggle and, preferably about 10 degrees past toggle. In the first, collapsed configuration, the first and second link outer ends 86, 88 are generally closer together than when the toggle assembly 80 is in the second, over-toggle configuration. In the reset configuration, the first and second link outer ends 86, 88 are much closer together causing the toggle joint 94 to be offset toward the ram 60 as shown in FIG. 7. The cradle assembly body 122 and the latch plate assembly body 152 are each structured to move between a first position and a second position as set forth below.

The opening assembly 52 operates as follows. As shown in FIG. 3, the opening assembly 52 and the ram 60 are in their respective positions that immediately follow a discharge of the closing assembly 54 as set forth in U.S. patent application Ser. No. 11/693,198. That is, the pole shaft 70 is in the second position, meaning that the contacts 26 are closed, and the toggle assembly 80 is in the second, over-toggle configuration. The cradle assembly body 122 is also in a second position wherein the lateral stop pin 126 is contacting the toggle assembly first link 82 adjacent to the toggle joint 94. The lateral stop pin 126 is the object that prevents the toggle assembly 80 from moving too far over-toggle. It is further noted that the cradle assembly lateral pivot shaft 124 is adjacent to, but not contacting the second link 84. The latch plate assembly body 152 is also in its second position wherein the latch plate assembly body latch edge 153 engages the D-shaft 160. D-shaft 160 is in its second position wherein the D-shaft 160 extends into the path of travel of the latch plate assembly body 152. When the latch plate assembly body 152 contacts the D-shaft 160, the latch plate assembly body 152 cannot move into the first position. The bias of the closing springs on the pole shaft 70 further biases, via the various linkages disclosed herein, the latch plate assembly body 152 to the first position. Thus, it is the latch plate assembly body 152 contact with the D-shaft 160 that prevents the opening assembly 52 from moving and allowing the contacts 26 to open.

The latch plate link 170 extends between the latch plate assembly body 152 and the cradle assembly body 122. It is noted that the latch plate link longitudinal extension 178 engages the latch plate assembly over rotation pin 158 in the reset position, described below. Further, the latch plate assembly lateral pivot shaft 154, the latch plate link first pivot point 174, and the latch plate link second pivot point 176 are disposed generally along a line. This is desirable as the contact load is minimized. The "contact load" is the force applied by the latch plate assembly body 152 on the D-shaft 160. A minimal load is desirable as the actual contact area between the latch plate assembly body 152 and the D-shaft 160 is small. Further a minimal load reduces the force required to release the D-shaft 160. It is further noted that, as shown, the ram 60 is in a forward, discharged position.

Figure 4:
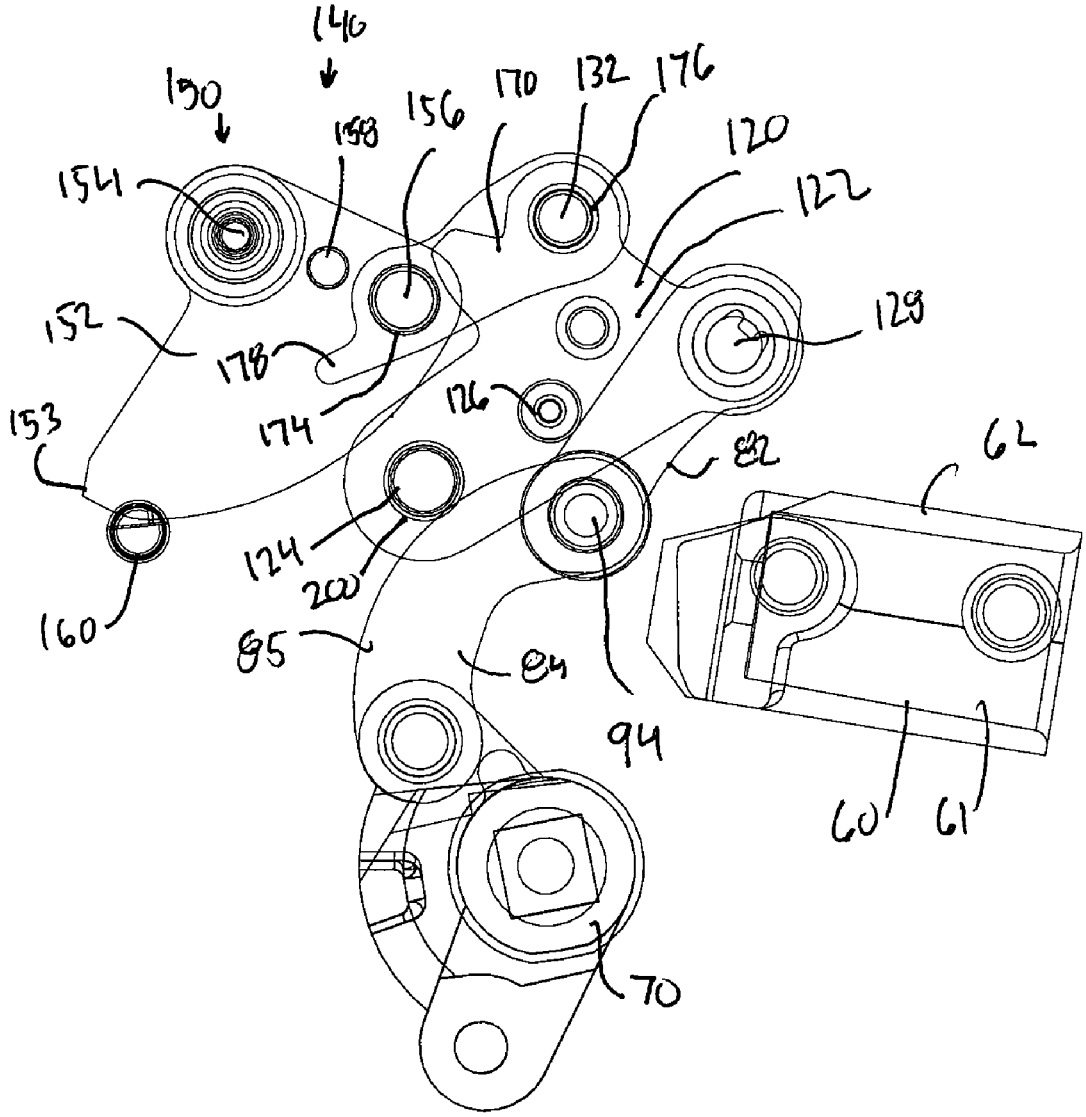
FIG. 4 is a schematic side view of the opening assembly during opening when the kicker pin initially engages the toggle assembly.

When an opening of the contacts 26 is initiated, for example, but not limited to, following an over-current condition trip or a manual opening, the D-shaft 160 rotates to a second position wherein the D-shaft 160 does not extend into the path of travel of the latch plate assembly body 152. As shown in FIG. 4, the latch plate assembly body latch edge 153 has moved past the D-shaft 160 and the latch plate assembly body 152 is pivoting clockwise as shown in the figures. As the latch plate assembly body 152 pivots, the latch plate link first pivot point 174 is moved clockwise as well. This motion is transferred via the latch plate link 170 to the cradle assembly body 122 causing the cradle assembly body 122 to move counter-clockwise about the cradle assembly lateral pivot shaft 124. At this point in time, the pole shaft 70 is not rotating, or rotating minimally, as the toggle assembly 80 is still in the over-toggle configuration. Thus, as the cradle assembly body 122 moves counter-clockwise about the cradle assembly lateral pivot shaft 124, the toggle assembly 80, and more specifically the toggle assembly first link 82 which is coupled to the cradle assembly body first link pivot point 128, also moves counter-clockwise.

The counter-clockwise motion of the toggle assembly 80 has two specific results. First, as the cradle assembly lateral pivot shaft 124 does not change position, the cradle assembly lateral pivot shaft 124 being the axis of rotation for the cradle assembly body 122, the toggle assembly 80 is moved toward the cradle assembly lateral pivot shaft 124. As shown in FIG. 4, the cradle assembly lateral pivot shaft 124 contacts the toggle assembly second link 84 adjacent to the toggle joint 94. As the toggle assembly 80 continues to move toward the cradle assembly lateral pivot shaft 124, the cradle assembly lateral pivot shaft 124 causes the toggle assembly 80 to move back through the in-line position from the over-toggle configuration. Thus, the cradle assembly lateral pivot shaft 124 acts as a kicker pin 200.

Figure 5:
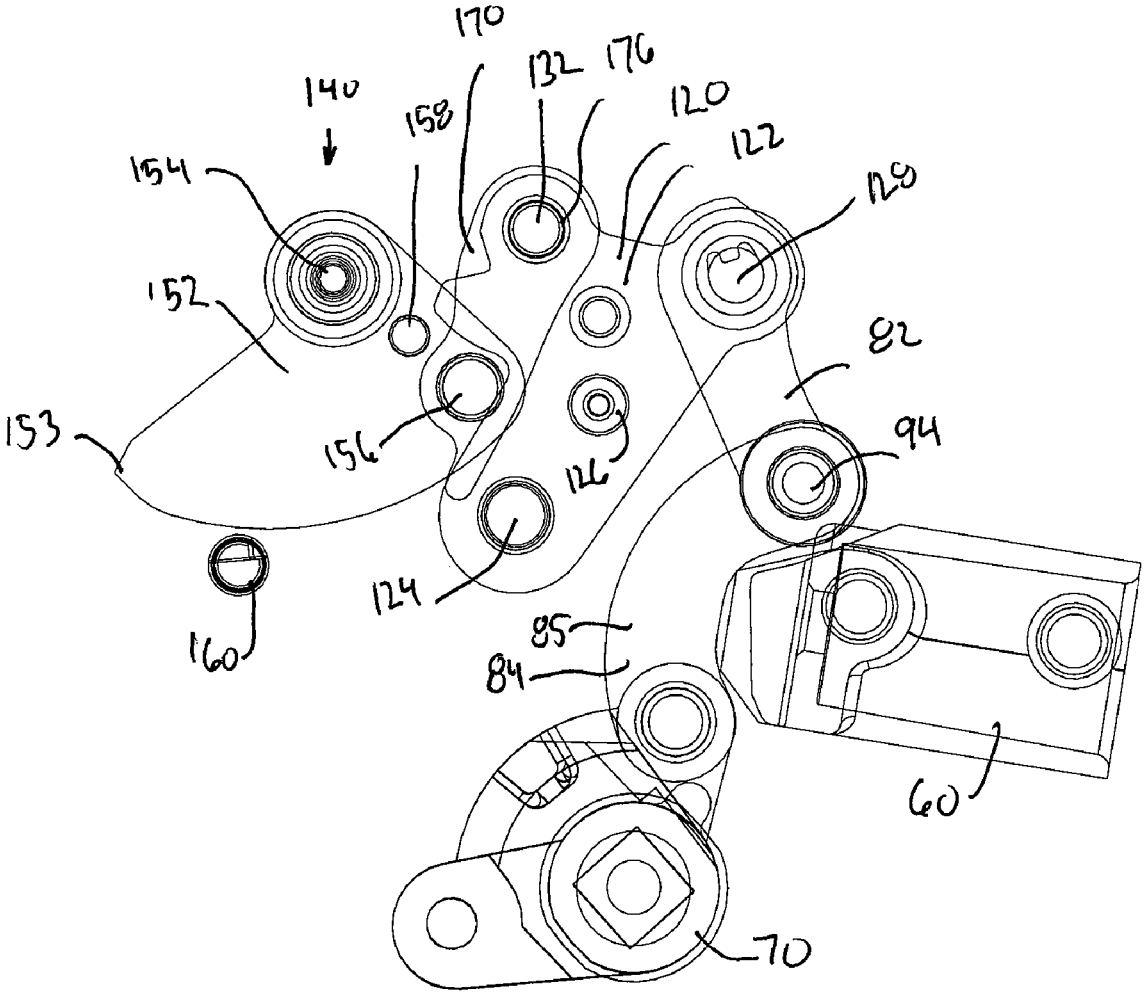
FIG. 5 is a schematic side view of the opening assembly when the contacts are open, the toggle assembly is in the first, collapsed configuration, and the ram assembly is discharged.

Further, as the toggle assembly first link 82 continues to move counter-clockwise with the cradle assembly body first link pivot point 128, the toggle assembly 80 and the toggle joint 94 are being pulled away from the ram 60. Thus, when the toggle assembly 80 passes through the toggle point and the toggle assembly 80 collapses into the first, collapsed configuration, as shown in FIG. 5, the toggle assembly 80 and the toggle joint 94 are moved away from the ram 60 which is an obstacle to collapse 62 for the toggle assembly 80. Further, the second link 84 is a curved body 85 structured to curve around the obstacle to collapse 62 when the toggle assembly 80 is in the first configuration. In this manner, the toggle assembly 80 may be collapsed without having to move the obstacle to collapse 62 which, as noted above, is typically the closing assembly 54 closing device.

Once the toggle assembly 80 passes through the toggle point and the toggle assembly 80 is collapsing into the first, collapsed configuration, the bias of the closing springs on the pole shaft 70 cause the pole shaft 70 to move into its first position wherein the contacts 26 are open. Further, in this configuration the cradle assembly body 122 and the latch plate assembly body 152 are each in their respective first positions.

Figure 6:
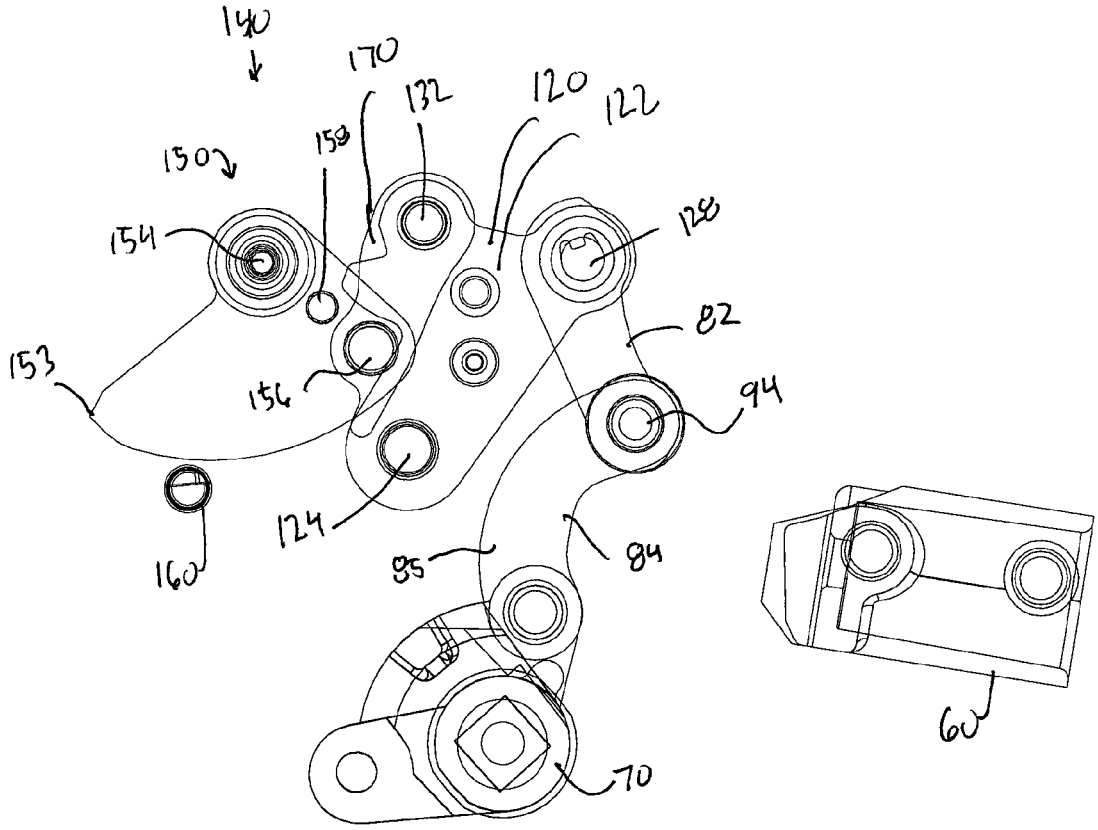
FIG. 6 is a schematic side view of the opening assembly when the contacts are open, the toggle assembly is in the first, collapsed configuration, and the ram assembly is charged.

Prior to closing the contacts 26 using the closing assembly 54, the opening assembly 52 must be reset. Initially, the closing assembly 54 closing device, which as shown is the ram 60, must be moved. Typically, this is accomplished by charging the closing assembly 54 and is shown in FIG. 6. Then, as shown in FIG. 7, the latch plate assembly body 152 is returned to its second position by rotating counter-clockwise about the latch plate assembly lateral pivot shaft 154. As before, the motion of the latch plate assembly body 152 is transferred via the latch plate link 170 to the cradle assembly body 122 causing the cradle assembly body 122 to move clockwise about the cradle assembly lateral pivot shaft 124. As the pole shaft 70 is maintained in its position by the bias of the opening springs, the motion of the cradle assembly body 122 causes the toggle assembly 80 to move into the reset configuration. As noted above, when the toggle assembly 80 is in the reset configuration, the toggle joint 94 is offset toward the ram 60. Further, as part of the reset operation, the D-shaft 160 is returned to its second position wherein the D-shaft 160 extends into the path of travel of the latch plate assembly body 152. It is also noted that, in this configuration, the latch plate link longitudinal extension 178 is structured to engage the latch plate assembly body over rotation pin 158 and prevent over-rotation of the cradle assembly body 122 relative to the latch plate assembly body 152 and stops the motion of the latch plate assembly body 152 relative to the cradle assembly body 122. Finally, from this configuration, the contacts 26 are closed, and the opening assembly 52 is returned to the configuration shown in FIG. 3, by actuating the closing assembly 54 as detailed in U.S. patent application Ser. No. 11/693,198.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An operating mechanism opening assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said operating mechanism closing assembly comprising:

a pole shaft rotatably disposed in said housing assembly and coupled to said at least one pair of contacts, wherein said pole shaft rotates between a first position, wherein said movable contact is in said first, open position and a second position, wherein said movable contact is in said second, closed position;

a toggle assembly having first link and a second link, each link having a first, outer end and a second, inner end, each link first, outer end having a pivot point and each link second, inner end having a pivot point;

said first link and a second link pivotally coupled together at said first link inner end and said second link inner end thereby forming a toggle joint, said toggle joint structured to move between a first, collapsed configuration, a second, over-toggle configuration, and a third reset/collapsed configuration;

said toggle assembly second link second end being pivotally coupled to said pole shaft wherein when said toggle assembly is in said first, collapsed configuration, said pole shaft is in said first position, and when said toggle assembly is in said second, over-toggle configuration said pole shaft is in said second position;

a cradle assembly having an elongated body with a first link pivot point and a lateral pivot shaft, said cradle assembly body being coupled to said cradle assembly lateral pivot shaft;

said toggle assembly first link pivotally coupled to said cradle assembly at said first link pivot point;

said cradle assembly lateral pivot shaft rotatably coupled to said housing assembly wherein said cradle assembly body is structured to move between a first position and a second position; and wherein said cradle assembly lateral pivot shaft is structured to act as a kicker pin causing said toggle assembly to move from said second, over-toggle configuration to said first, collapsed configuration as said cradle assembly body moves from said second position to said first position.

2. The operating mechanism opening assembly of claim 1 wherein:

said cradle assembly includes a lateral stop pin;

said lateral stop pin coupled to said cradle assembly body and disposed generally between said cradle assembly lateral pivot shaft and said first link pivot point; and said lateral stop pin structured to engage said toggle joint when said toggle assembly is in second, over-toggle configuration.

3. The operating mechanism opening assembly of claim 2 wherein said lateral stop pin does not act as a kicker pin.

4. The operating mechanism opening assembly of claim 3 wherein said electrical switching apparatus includes a closing assembly, said closing assembly having a link driving device, said link driving device structured to move said toggle assembly from said third, reset configuration to said second, over-toggle configuration, said link driving device being in a first position when said toggle assembly is in said third, reset configuration and said link driving device being in a second position when said toggle assembly is moved into said second, over-toggle configuration, wherein when said link driving device is in said second position, said link driving device is in the path of travel of said toggle joint and is an obstacle to collapse, and wherein:

as said cradle assembly body moves from said second position to said first position, said first link pivot point and said toggle joint are moved away from said obstacle to collapse.

5. The operating mechanism opening assembly of claim 4 wherein:

said toggle assembly second link has an elongated, curved body; and said toggle assembly second link curved body structured to curve around said obstacle to collapse when said toggle assembly is in said first configuration.

6. An operating mechanism opening assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said electrical switching apparatus further including a closing assembly, said closing assembly having a link driving device, said link driving device structured to move said toggle assembly from said third, reset configuration to said second, over-toggle configuration, said link driving device being in a first position when said toggle assembly is in said third, reset configuration and said link driving device being in a second position when said toggle assembly is moved into said second, over-toggle configuration, wherein when said link driving device is in said second position, said link driving device is in the path of travel of said toggle joint and is an obstacle to collapse, said operating mechanism closing assembly comprising:

a pole shaft rotatably disposed in said housing assembly and coupled to said at least one pair of contacts, wherein said pole shaft rotates between a first position, wherein said movable contact is in said first, open position and a second position, wherein said movable contact is in said second, closed position;

a toggle assembly having first link and a second link, each link having a first, outer end and a second, inner end, each link first, outer end having a pivot point and each link second, inner end having a pivot point;

said first link and a second link pivotally coupled together at said first link inner end and said second link inner end thereby forming a toggle joint, said toggle joint structured to move between a first, collapsed configuration, a second, over-toggle configuration, and a third reset/collapsed configuration;

said toggle assembly second link outer end being pivotally coupled to said pole shaft wherein when said toggle assembly is in said first, collapsed configuration, said pole shaft is in said first position, and when said toggle assembly is in said second, over-toggle configuration said pole shaft is in said second position;

a cradle assembly having an elongated body with a first link pivot point and a lateral pivot shaft, said cradle assembly body being coupled to said cradle assembly lateral pivot shaft;

said toggle assembly first link pivotally coupled to said cradle assembly at said first link pivot point; and said cradle assembly lateral pivot shaft rotatably coupled to said housing assembly wherein said cradle assembly body is structured to move between a first position and a second position and wherein as said cradle assembly body moves from said second position to said first position, said first link pivot point and said toggle joint are moved away from said obstacle to collapse.

7. The operating mechanism opening assembly of claim 6 wherein:

said toggle assembly second link has an elongated, curved body; and said toggle assembly second link curved body structured to curve around said obstacle to collapse when said toggle assembly is in said first configuration.

8. The operating mechanism opening assembly of claim 7 wherein said cradle assembly lateral pivot shaft is structured to act as a kicker pin causing said toggle assembly to move from said second, over-toggle configuration to said first, collapsed configuration as said cradle assembly body moves from said second position to said first position.

9. The operating mechanism opening assembly of claim 8 wherein:

said cradle assembly includes a lateral stop pin;

said lateral stop pin fixed to said cradle assembly body and disposed generally between said cradle assembly lateral pivot shaft and said first link pivot point; and said lateral stop pin structured to engage said toggle joint when said toggle assembly is in second, over-toggle configuration.

10. A cradle assembly within an operating mechanism opening assembly for an electrical switching apparatus, said operating mechanism opening assembly having a toggle assembly structured to move between a first, collapsed configuration and a second, over-toggle configuration, said cradle assembly comprising:

an elongated body with a first link pivot point and a lateral pivot shaft, said cradle assembly body being coupled to said cradle assembly lateral pivot shaft; and wherein said cradle assembly lateral pivot shaft is structured to act as a kicker pin causing said toggle assembly to move from said second, over-toggle configuration to said first, collapsed configuration.

11. The cradle assembly of claim 6 wherein:

said cradle assembly includes a lateral stop pin;

said lateral stop pin fixed to said cradle assembly body and disposed generally between said cradle assembly lateral pivot shaft and said first link pivot point; and said lateral stop pin structured to engage said toggle assembly when said toggle assembly is in second, over-toggle configuration.

12. An operating mechanism opening assembly for an electrical switching apparatus, said electrical switching apparatus having a housing assembly and at least one pair of contacts having a fixed contact and a movable contact disposed in said housing assembly, said movable contact structured to move between a first, open position, wherein said contacts are separated, and a second, closed position, wherein said contacts contact each other and are in electrical communication, said electrical switching apparatus further including a D-shaft structured to selectively rotate between a first position and a second position, said operating mechanism closing assembly comprising:

a pole shaft rotatably disposed in said housing assembly and coupled to said at least one pair of contacts, wherein said pole shaft rotates between a first position, wherein said movable contact is in said first, open position and a second position, wherein said movable contact is in said second, closed position;

a toggle assembly having first link and a second link, each link having a first, outer end and a second, inner end, each link first, outer end having a pivot point and each link second, inner end having a pivot point;

said first link and a second link pivotally coupled together at said first link inner end and said second link inner end thereby forming a toggle joint, said toggle joint structured to move between a first, collapsed configuration, a second, over-toggle configuration, and a third reset/collapsed configuration;

said toggle assembly second link outer end being pivotally coupled to said pole shaft wherein when said toggle assembly is in said first, collapsed configuration, said pole shaft is in said first position, and when said toggle assembly is in said second, over-toggle configuration said pole shaft is in said second position;

a cradle assembly having an elongated body with a first link pivot point, a latch plate link pivot point and a lateral pivot shaft, said cradle assembly body being coupled to said cradle assembly lateral pivot shaft;

said toggle assembly first link pivotally coupled to said cradle assembly at said first link pivot point;

said cradle assembly lateral pivot shaft rotatably coupled to said housing assembly wherein said cradle assembly body is structured to move between a first position and a second position;

a latch plate assembly having a body and a lateral pivot shaft, said latch plate assembly body having a latch edge, a latch plate link pivot point, and a lateral over rotation pin, and, said latch plate assembly body being coupled to said latch plate assembly lateral pivot shaft;

said latch plate assembly latch edge structured to engage said D-shaft when said D-shaft is in said second position;

said latch plate lateral pivot shaft rotatably coupled to said housing assembly wherein said latch plate assembly body is structured to move between a first position, when said latch plate assembly latch edge does not engage said D-shaft, and a second position, wherein said latch plate assembly latch edge engages said D-shaft and wherein said latch plate assembly body is not free to rotate;

a latch plate link having an elongated body with a first pivot point, a second pivot point and a longitudinal extension, said longitudinal extension extending generally longitudinally outwardly beyond said first pivot point;

said latch plate link first pivot point pivotally coupled to said latch plate assembly body latch plate link pivot point, with said latch plate link longitudinal extension extending adjacent to, and structured to engage, said latch plate assembly body over rotation pin;

said latch plate link is pivotally coupled to said cradle assembly body latch plate link pivot point; and wherein, said latch plate link longitudinal extension is structured to engage said latch plate assembly body over rotation pin when said latch plate assembly body is in said second position and said cradle assembly body is in said reset configuration.

13. The operating mechanism opening assembly of claim 12 wherein said latch plate link longitudinal extension is structured to engage said latch plate assembly body over rotation pin and prevent over-rotation of said cradle assembly body relative to said latch plate assembly body when said toggle assembly is in said second position.

14. The operating mechanism opening assembly of claim 12 wherein said latch plate link longitudinal extension is structured to engage said latch plate assembly body over rotation pin when said latch plate assembly lateral pivot shaft, said latch plate link first pivot point, and said latch plate link second pivot point are disposed generally along a line.

15. The operating mechanism opening assembly of claim 14 wherein said cradle assembly lateral pivot shaft is structured to act as a kicker pin causing said toggle assembly to move from said second, over-toggle configuration to said first, collapsed configuration as said cradle assembly body moves from said second position to said first position.

16. The operating mechanism opening assembly of claim 15 wherein:

said cradle assembly includes a lateral stop pin;

said lateral stop pin fixed to said cradle assembly body and disposed generally between said cradle assembly lateral pivot shaft and said first link pivot point; and said lateral stop pin structured to engage said toggle joint when said toggle assembly is in second, over-toggle configuration.

17. The operating mechanism opening assembly of claim 14 wherein said electrical switching apparatus includes a closing assembly, said closing assembly having a link driving device, said link driving device structured to move said toggle assembly from said third, reset configuration to said second, over-toggle configuration, said link driving device being in a first position when said toggle assembly is in said third, reset configuration and said link driving device being in a second position when said toggle assembly is moved into said second, over-toggle configuration, wherein when said link driving device is in said second position, said link driving device is in the path of travel of said toggle joint and is an obstacle to collapse, and wherein:

as said cradle assembly body moves from said second position to said first position, said first link pivot point and said toggle joint are moved away from said obstacle to collapse.

18. The operating mechanism opening assembly of claim 17 wherein:

said toggle assembly second link has an elongated, curved body; and said toggle assembly second link curved body structured to curve around said obstacle to collapse when said toggle assembly is in said first configuration.

19. A latch plate assembly for an electrical switching apparatus operating mechanism opening assembly comprising:

a body with a latch edge and a latch plate link pivot point, a lateral over rotation pin;

a lateral pivot shaft; and said body being coupled to said lateral pivot shaft.

20. The latch plate assembly of claim 19 wherein said lateral over rotation pin coupled to said body adjacent to said latch plate link pivot point.

* * * * *